US005463828A

United States Patent [19]

Andrejevic

[11] Patent Number: 5,463,828

[45] Date of Patent: Nov. 7, 1995

[54] SHOT GUN

[75] Inventor: Ratomir Andrejevic, Johannesburg, South Africa

[73] Assignee: Techno Arms (PTY) Ltd., Johannesburg, South Africa

[21] Appl. No.: 181,054

[22] Filed: Jan. 14, 1994

[51] Int. Cl.[6] ..... F41A 3/52

[52] U.S. Cl. ..... 42/20; 42/69.03; 89/24; 89/186; 89/189; 89/190

[58] Field of Search ..... 42/16, 17, 20, 42/69.03; 89/24, 181, 186, 189, 190

[56] References Cited

U.S. PATENT DOCUMENTS

| | | | |
|---|---|---|---|
| 576,744 | 2/1897 | Seymour | 42/16 |
| 2,324,775 | 7/1943 | Hentschel | 42/16 |
| 2,341,260 | 2/1944 | Barnes | 42/16 |

FOREIGN PATENT DOCUMENTS

| | | | |
|---|---|---|---|
| 403813 | 3/1911 | France | 42/16 |
| 1166264 | 11/1961 | France | 42/17 |
| 489241 | 1/1930 | Germany | 42/16 |

*Primary Examiner*—Stephen M. Johnson
*Attorney, Agent, or Firm*—Nixon & Vanderhye

[57] ABSTRACT

A gun 10, such as a shot gun or the like, of the type which includes a firing pin carrying bolt 25 which is reciprocally movable relative to the firing chamber 23 of the gun 10 between a first or firing position where the firing pin 29 can engage the rear end of a cartridge 22 located in the firing chamber 23 of the gun 10, to a second or reload position located towards the rear end of the gun 10, the gun 10 being characterised in that it includes at least two locks for positively maintaining the bolt the firing position while and after a shot has been fired and before the gun is reloaded, the locks comprising a first one 39 located rearwardly of and at a level above the firing chamber 23 of the gun 10, and at least one of two further locks, the second one 51 located at a level below and in a position forward of the firing chamber 23, and a third one 77 located at a level below and in a position rearwardly of the firing chamber 23. The three locks are so located and operate in such a manner that the barrel 12 of the gun shows substantially no tendency to move in an upward direction when a shot is being fired by gun 10.

28 Claims, 11 Drawing Sheets

SHOT GUN

BACKGROUND OF THE INVENTION

This invention relates to a gun such as a shot gun or the like.

Most of the conventional types of shot guns are characterised by the fact that their muzzles tend to move upwardly when a shot is fired which of course impairs their shooting accuracy.

Another problem encountered with the conventional type of shot gun or the like is that it is usually of large dimensions, especially in so far as its length is concerned.

SUMMARY OF THE INVENTION

It is accordingly an object of this invention to provide a gun such as shot gun or the like with which the applicant believes the aforesaid problems may be overcome or at least minimised.

According to one aspect of the invention a gun, such as a shot gun or the like, which includes a firing pin carrying bolt which is reciprocally movable relative to the firing chamber of the gun between a first or firing position where the firing pin can engage the rear end of a cartridge located in the firing chamber of the gun, to a second or reload position located towards the rear end of the gun, is provided, the gun being characterised in that it includes at least two locks for positively maintaining the bolt in the firing position while and after a shot has been fired and before the gun is reloaded, the locks comprising a first one located rearwardly of and at a level above the firing chamber of the gun, and at least one of two further locks, a second one located at a level below and in a position forwardly of the firing chamber, and a third one located at a level below and in a position rearwardly of the firing chamber.

Applicant has found that locking the bolt in this manner substantially reduces the tendency of the muzzle of the gun to move in an upward direction after a shot has been fired.

Applicant believes that the aforesaid effect is achieved through the balancing of the forces resulting from the explosion caused by the firing of the gun.

Further according to the invention engagement of the bolt by the first lock takes place against the biasing action of a suitable spring or the like.

Still further according to the invention the gun includes all three of the said first, second and third locks, the arrangement being such that at least two of the aforesaid locks simultaneously maintain the bolt in the firing position while and after a shot has been fired.

Still further according to the invention the relative positions of the first, second and third locks in relation to the rear end of the firing chamber is such that when a shot is fired the angles of the resultant forces acting on such locks relative to the longitudinal axis of the barrel of the gun are twice as great for the third lock than for the second lock, while that of the first lock is substantially parallel to the said axis.

Still further according to the invention the distance between the first lock and a line extending at the rear end of the firing chamber at right angles to the longitudinal axis of the barrel of the gun is substantially one-half that between the third lock and the said line and substantially one-quarter times that between the second lock and the said line; and the distance between the second and third locks is substantially equal to the length of the barrel of the gun measured from said line and the front end of the barrel.

Applicant has found experimentally that a gun with such a locking configuration give the best results in so far as the balancing of such explosive forces is concerned.

Still further according to the invention the bolt is supported during its aforesaid movement on a carriage which slidably engages a track provided on the body of the gun.

Still further according to the invention the carriage is of elongated configuration with its one or front end being adapted to engage the said second lock and its other or rear and being adapted to carry the bolt.

Still further according to the invention the said front end of the carriage is connected to a hand engagable cocking grip by means of which the carriage can manually be moved from the firing to the reload position.

Preferably the cocking grip is pivotally connected to the carriage via a toggle type hinge.

Still further according to the invention the cocking grip includes a spring biased hook which can releasably engage a complimentary shaped formation on the body of the gun which is located forwardly of the firing chamber and below the level of the barrel of the gun, the said hook and formation collectively defining the said second lock of the gun.

Still further according to the invention the said spring biased hook on the cocking grip can be released from its said spring biased engagement with its complimentary formation by means of a finger engagable button located on the grip.

Still further according to the invention the bolt includes an elongated slot located on that side of it which engages the carriage, and the carriage includes an elongated protrution which fits snugly into the aforesaid slot, the slot and the protrution having interengagable locking formations for positively locking the bolt against movement relative to the carriage towards the firing position, but allowing limited movement of the bolt relative to the carriage towards the reloading position against the biasing action of the said spring associated with the said first lock.

Thus, for example, the locking formations can comprise interengagable sarrations which lock positively in one direction but which allow limited movement of the bolt relative to the carriage in the opposite direction.

Still further according to the invention the locking formations on the bolt are contained on an elongated element which is located in the said slot for tiltable movement substantially transversely relative to the longitudinal axis of the barrel of the gun to a position where at least part of the element can protrude through an aperture provided in that side of the bolt opposite the side which engages the carriage, the said protruding part including a hook which can positively engage a lip on the barrel of the gun to constitute the aforesaid first lock of the gun; the said transverse tilting of the element being effected when the bolt undergoes its aforesaid limited movement relative to the carriage.

It will hence be appreciated that the said first lock is located rearwardly of, and at a level above, the barrel of the gun.

Still further according to the invention the firing pin is movable against the biasing action of a spring or the like in aligned apertures respectively provided in the ends of the bolt and in the said elongated element of the bolt.

Still further according to the invention the aforesaid tiltable movement of the elongated element is effected by having it pivotally connected to the firing pin.

Still further according to the invention that end of the locking formations on the carriage facing the firing chamber is provided with an axially extending blind hole in which the aforesaid spring associated with the said first lock together with a pin can be housed, the pin being adapted to be engaged and moved against the biasing action of the spring into the hole by the bolt when the latter undergoes its aforesaid limited movement relative to the carriage towards the reload position.

Still further according to the invention the gun includes a spring biased element which is pivotally contained towards the rear end of the barrel housing of the gun so that it is in a position located rearwardly of and below the level of the carriage of the gun, the element being capable of movement against the action of its spring in a transverse direction relative to the longitudinal axis of the barrel of the gun from a first position where it defines an obstacle in the way of the carriage in its movement from the firing position towards the reload position, to a second position where it does not, the arrangement thus constituting a third lock for maintaining the bolt in the firing position.

Still further according to the invention movement of the aforesaid element from its first to its second position is associated with movement of the trigger mechansim of the gun.

Still further according to the invention a hand operable overide for moving the aforesaid element from its first to second positions is also provided.

Still further according to the invention a spring biased hammer, which in operation is adapted to engage the rear end of the firing pin, is provided along the track in a position so that when the bolt moves from the firing position to the reload position, the hammer moves against the biasing action of its spring into the cocked position into which it can releasably be locked, the lock being adapted to be released by the trigger mechanism of the gun.

When the bolt accordingly has moved into the firing position, and the trigger mechanism activated, the hammer is released from its cocked position and moves under the biasing action of its spring into engagement with the rear end of the firing pin.

Still further according to the invention the bolt includes towards its end facing the firing chamber a spring biased hook formation which is adapted to engage and grip the rim of a cartridge when the latter is pushed by the bolt into the firing chamber so that when the bolt moves away from the firing chamber after a shot had been fired, the hook formation can pull the spent cartridge from the firing chamber in order for it to be ejected from the gun through a side aperture provided in the body of the gun.

Still further according to the invention the gun includes a safety catch which keeps the hammer in the aforesaid cocked position even if the trigger mechanism is operated.

It will be appreciated that this constitutes a safety mechanism which, together with the aforesaid first lock associated with the cocking grip, provides a double safe guard against accidental cocking and/or firing of the gun.

According to another aspect of the invention the gun includes an elongated cartridge chamber which is open at both ends and through which cartridges may be fed from a spring loaded magazine towards the firing chamber of the gun.

Still further according to the invention the end walls of the cartridge chamber slope towards the firing position at an angle in the order of 70° relative to the longitudinal axis of the gun.

Preferably the upper end of that sloping wall of the cartridge chamber nearest the firing position is provided with a curved, more pronounced, sloping surface which constitutes a breach ramp for the gun and which facilitates movement of a cartridge from the magazine via the cartridge chamber to the firing chamber.

Still further according to the invention the upper or outlet end of the cartridge chamber is located below the track of the carriage so that when the latter moves over the said outlet on its way from the reload to the firing position, its front end can carry a cartridge from the magazine via the breach to the firing chamber; and when it moves away from the outlet on its way towards the reload position, it allows the next cartridge in the magazine to move into position.

Still further according to the invention the gun includes a hollow pistol-type grip for holding and handling the gun, the bore of the grip, which is of substantial rectangular configuration in cross section, being in line with that of the cartridge chamber and being further adapted releasably to receive the aforesaid cartridge magazine.

It will be appreciated that by utilising the pistol grip of the gun in this manner, the dimensions of a gun according to the invention, particularly in so far as its length is concerned, can be substantially less that those of a conventional type of shot gun.

BRIEF DESCRIPTION OF THE DRAWINGS FIGURES

One embodiment of the invention will now be described by way of example with reference to the enclosed drawings in which.

DESCRIPTION OF A PREFERRED EMBODIMENT

Figure 1:
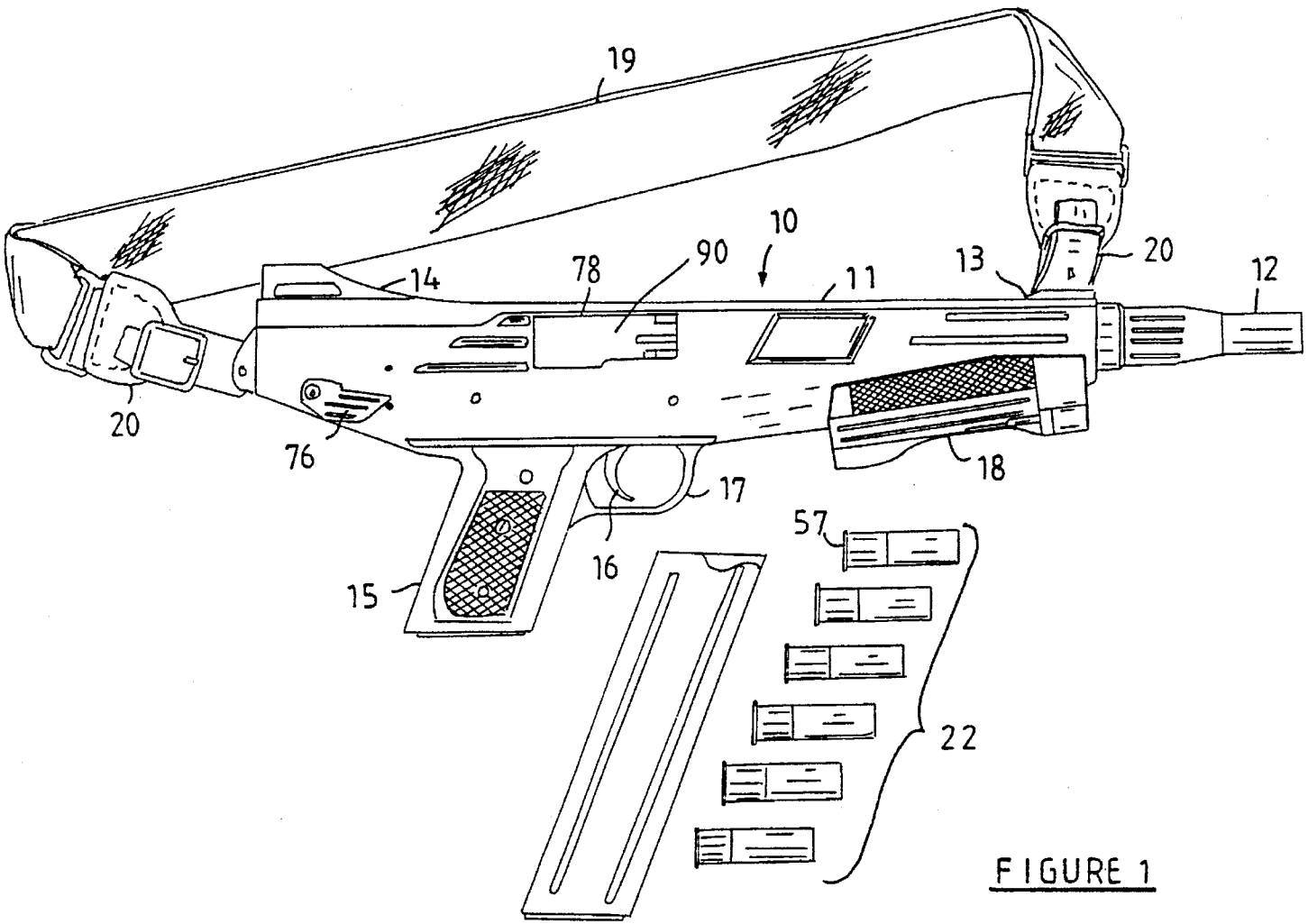
FIG. 1 is a diagrammatic side elevation of one embodiment of a gun according to the invention.

In this embodiment of the invention a shot gun 10 according to the invention comprises a body 11; a barrel 12; a front and rear sight 13 and 14 respectively; a pistol type grip 15; a trigger and trigger guard 16 and 17 respectively; a cocking grip 18 and a gun belt 19 of which the ends are releasably secured by means of buckles 20 to the rear and front ends of body 11.

Figure 2:
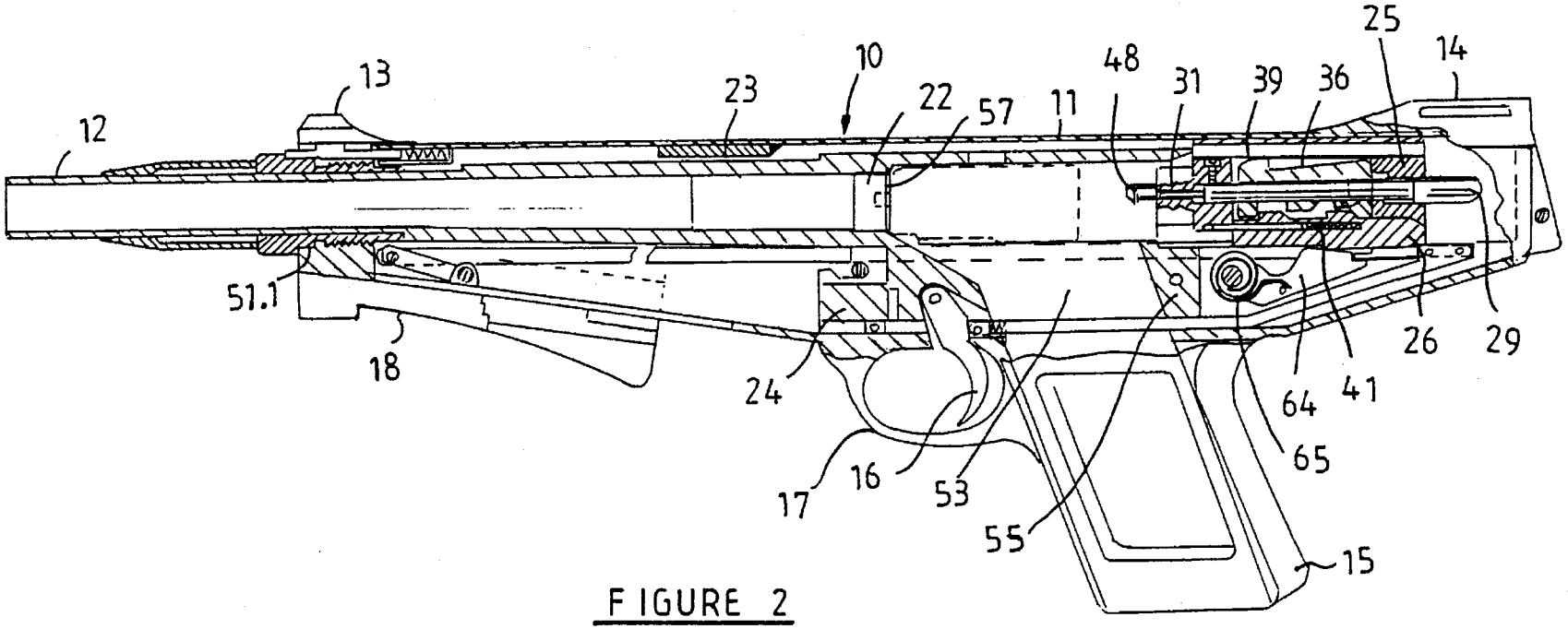
FIG. 2 is a longitudinal section through the gun of FIG. 1.

Gun 10 is used in association with a spring loaded magazine 21 which can carry a plurality of shot gun cartridges 22, of which one is shown in FIG. 2 in position in the firing chamber 23 of gun 10.

Figure 14:
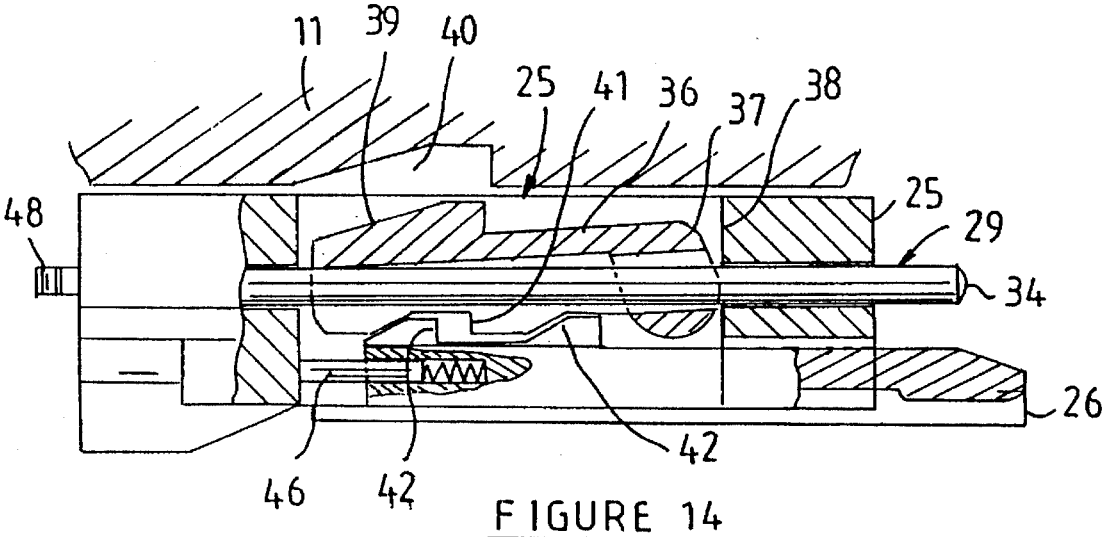
FIGS. 14 and 15 are diagrammatic longitudinal sectional views showing some of the components of the gun of FIG. 1 in two different operational positions.
Figure 15:
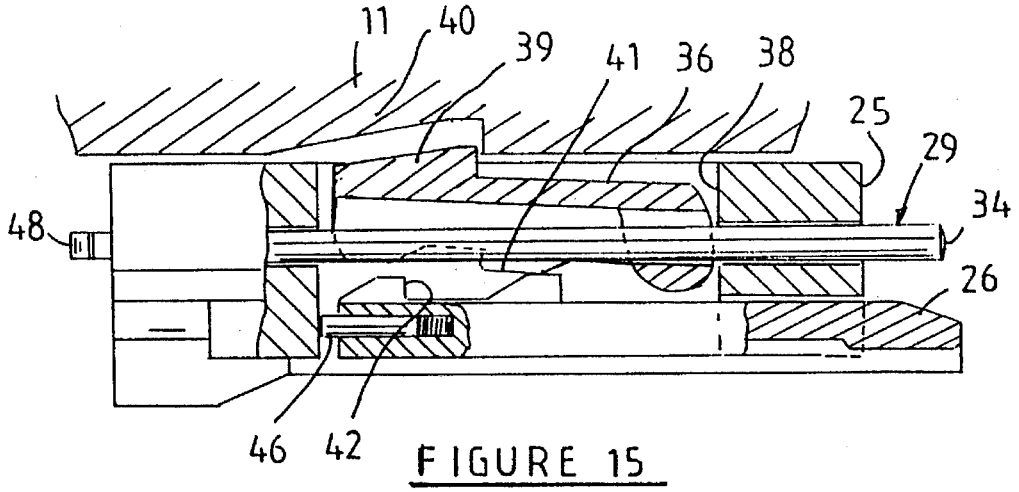
Figure 16:
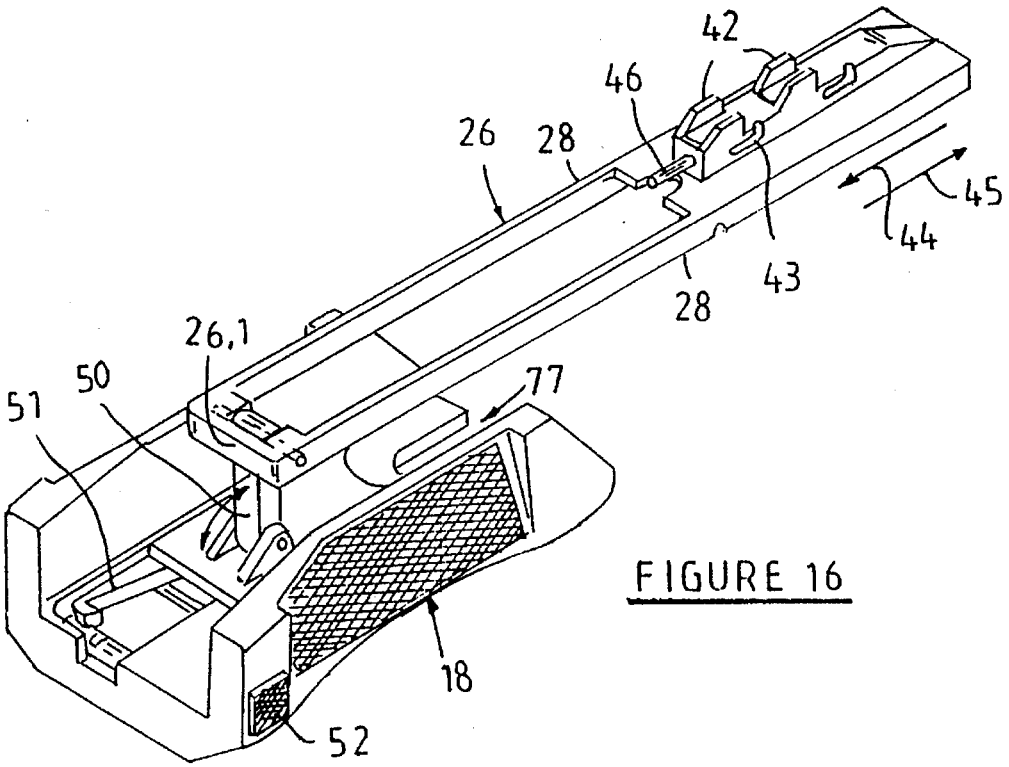
FIG. 16 is a diagrammatic perspective view of the bolt carriage of the gun of FIG. 1.

Gun 10 includes a barrel housing 24 which is shown in more detail in FIGS. 5 to 9 and 19 and 20; a firing bolt 25 which is shown in more detail in FIGS. 12 to 15, and which is carried for reciprocating movement in the longitudinal direction relative to housing 24 on an alongated carriage 26, which is shown in more detail in FIG. 16 and which is connected towards its one or front end to cocking grip 18.

Carriage 26 is slidably movable relative to housing 24 along a track defined by two elongated ledges 27 (FIG. 5) provided along the opposite longitudinal edges of housing 24 and which are each adapted to be engaged slidably by two downwardly depending flanges 28 extending along each longitudinal side of carriage 26.

Bolt 25 is provided with a firing pin 29 which is slidably movable in an aperture 30 (FIG. 13) provided in the body of bolt 25.

Figure 12:
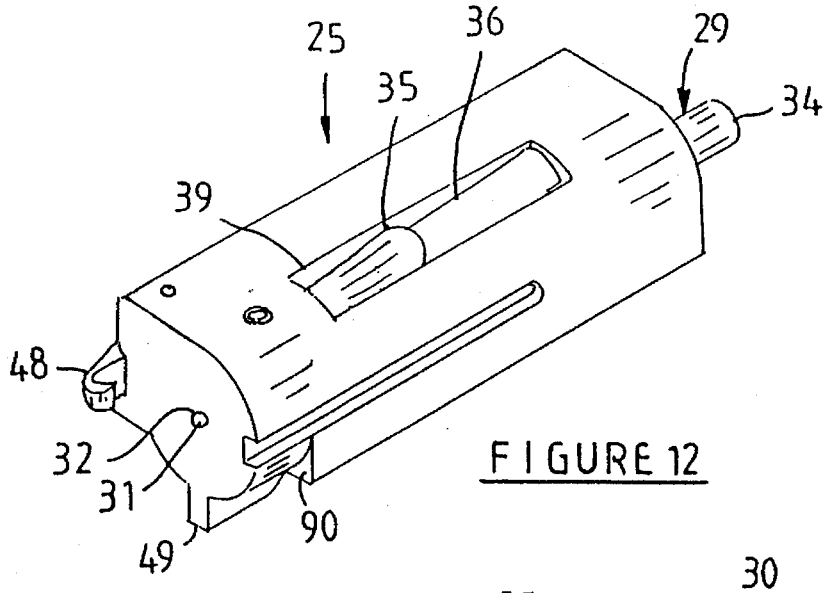
FIG. 12 is a diagrammatic perspective view of the bolt of the gun of FIG. 1.
Figure 13:
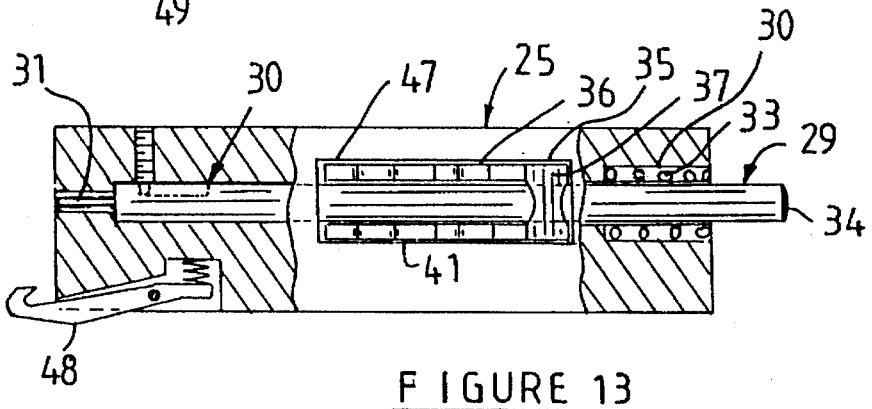
FIG. 13 is a longitudinal section through the bolt of FIG. 12.

The leading end of pin 29 is connected to a striking pin 31 which is maintained withdrawn in its aperture 32 (FIG. 12) by means of a spring 33 (FIG. 13). Pin 29 is of such length that its rear end 34 projects from the rear end of bolt 25.

Bolt 25 is provided with a slot 35 which extends right through the body of bolt 25 from its under side (FIG. 13) to its upper side (FIG. 12). As can be seen from FIG. 13, the inner ends of aperture 30 extend into slot 35.

Bolt 25 is provided with an elongated element 36 which includes a transversely extending bush 37 (FIG. 13) towards its one end through which pin 29 passes slidably so that element 36 is pivotally movable relative to pin 29, a transversely extending wall 38 in slot 35 (FIGS. 14 and 15) limiting its sliding movement along pin 29 in one direction.

Element 36, which is provided with a transversely extending hook formation 39 towards its one end, is of such dimensions that when it is at its one extreme pivotal position (FIGS. 15 and 21), it protrudes from the mouth of slot 35 to define a hook which can engage a complementary shaped lip 40 provided in the wall of the rear end of barrel 12 of gun 10, and when it has moved away from this extreme position (FIGS. 14 and 22), the upper end of hook 39 is flush with the mouth of slot 35.

Element 36 is provided on its underside with serrations 41 which define locking formations which can engage complementary shaped locking formations 42 (FIG. 16) provided on a protrusion 43 provided on the upper face of carriage 26.

Figure 21:
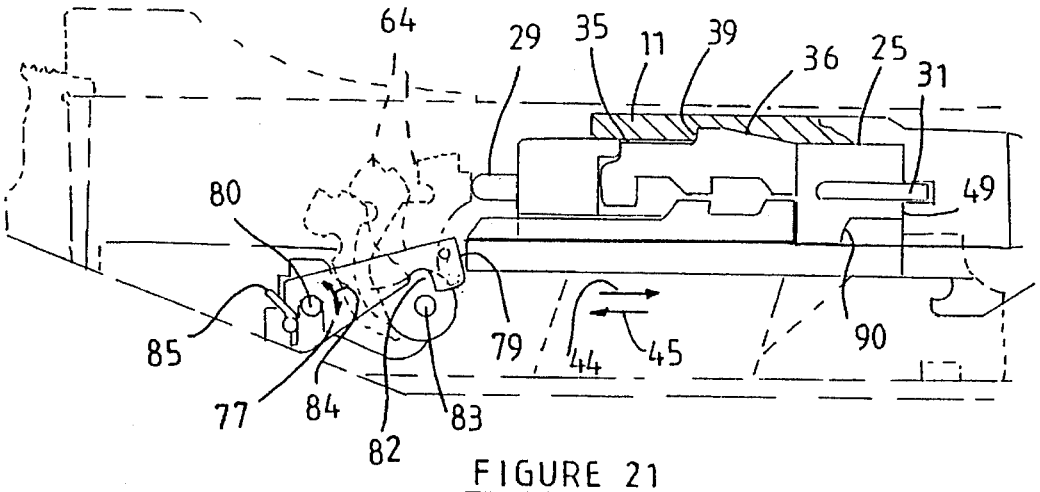
FIGS. 21 and 22 are diagrammatical longitudinal sectional views showing some of the components of the gun of FIG. 1 in two different opperational positions.
Figure 22:
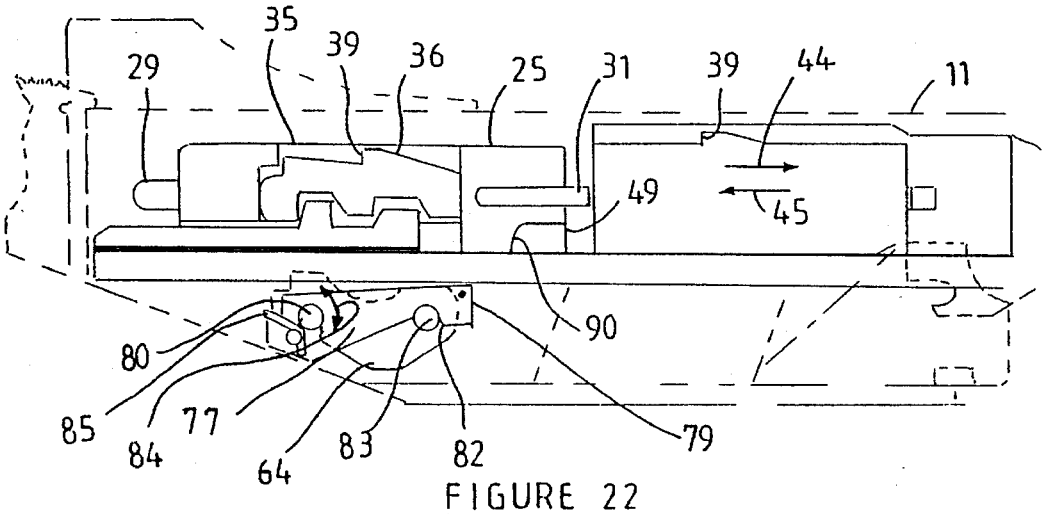

As can be seen from FIGS. 14 and 15, locking formations 41 and 42 are so shaped that they define alternate transversely extending and sloping surfaces so that when bolt 25 is located on top of carriage 26 these locking formations intergage in a manner which locks element 36, and hence bolt 25, positively to carriage 26 for movement of the latter in the direction of the firing position (indicated by arrows 44 in FIGS. 16, 21 and 22) while allowing element 36 and hence bolt 25 movement relative to carriage 26 in the direction towards the reload position (indicated by arrow 45 in FIGS. 16, 21 and 22).

It will be appreciated that during the latter movement the aforesaid sloping surfaces will cause element 36 to pivot on its bush 37 and hence cause hook 39 to protrude through the mouth of slot 35 to engage lip 40.

Hook 39 and lip 40 therefor collectively define a look (the 'first' lock referred to above) for maintaining bolt 25 in the firing position.

Protrusion 43 is provided with a blind hole in which a spring biased pin 46 (FIGS. 14, 15 and 16) is carried and of which the leading end can be engaged by the inner wall 47 (FIG. 13) of groove 35 of bolt 25 when the latter is located on top of carriage 26 with their locking formations 41 and 42 interengaging.

It will accordingly be appreciated that the aforesaid movement of bolt 25 relative to carriage 26 in the direction of arrow 45 will be against the biasing action of such spring.

The leading end of bolt 25 also includes a spring biased hook formation 48 and a rearwardly sloping nose formation 49, the purposes of which will be explained later.

The leading end of carriage 26 is connected by means of a toggle type hinge 50 (FIG. 16) to cocking grip 18. Grip 18 is accordingly capable of movement in a transversed direction to and away from the body of gun 10, the arrangement being such that grip 18 can only move carriage 26 towards the reload position in the direction indicated by arrow 45 in FIG. 16 when grip 18 is pivoted on hinge 50 to the position where it is moved away from the body of gun 10.

Figure 17:
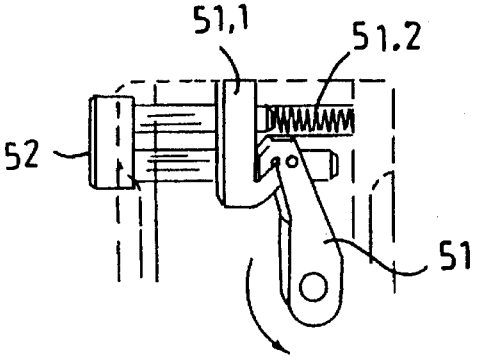
FIGS. 17 and 18 are side-on perspective views showing part of the components of the bolt carriage of the gun shown in FIG. 16 in more detail.
Figure 18:
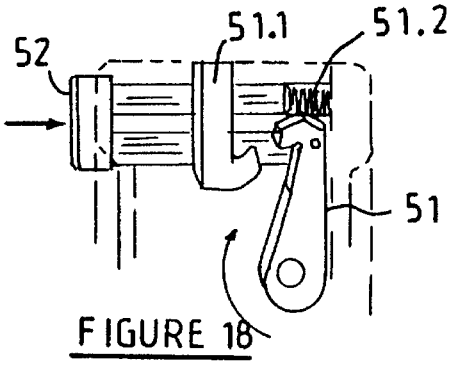

Grip 18, which is of channel shape so that it can extend around part of the body of gun 10, also includes a hook formation 51 which can engage a complementary shaped formation 51.1 (FIGS. 2, 17 and 18) on body 11 of gun 10 when grip 18 is moved on hinge 50 to the position where it abuts body 10. Hook formation 51 can be released from formation 51.1 by means of a finger engagable button 52 provided on the side of grip 18. Movement of formation 51 towards the release position is against the action of a spring 51.2 carried on grip 18. Formations 51 and 51.1 therefor collectively define a lock (the 'second' lock referred to above) for maintaining bolt 25 in the firing position.

Also, when grip 18 is locked to body 11 by means of hook 51, the gun is rendered 'safe' in the sense that it cannot be cocked.

Carriage 26 is of such length that when it is moved to its extreme position in the direction of arrow 45 its leading end 26.1 (FIG. 16) engages the leading end 24.1 (FIG. 5) of barrel housing 24.

Barrel housing 24, which is preferably of aluminium, includes a first aperture 53 (FIG. 5) which extends right through it. The lower mouth of aperture 53 is located exactly in line with the upper end of pistol grip 15.

Aperture 53, which defines a cartridge receiving chamber for gun 10, has its two opposite end walls 54 (FIGS. 5, 19 and 20) and 55 (FIGS. 2, 5, 19 and 20) sloping at an angle of approximately 70° relative to the longitudinal axis of gun 10.

Pistol grip 15 has an elongated aperture 56 (FIG. 2) which extends right through it and of which the end walls also slope at an angle of 70° so that they are in line with the end walls 54 and 55 of chamber 53.

Aperture 56 is of such dimensions that it can slidably receive cartridge magazine 21 pushed into it from below until its upper and passes into chamber 53 so that the uppermost cartridge 22 in magazine 21 can be engaged by nose formation 49 (FIG. 12) of bolt 25 when the latter passes over chamber 53 during its movement from the aforesaid reload position towards the firing position.

During the aforesaid movement, hook formation 48 on bolt 25 will engage the annular rim 57 (FIG. 1) located at the rear end or a cartridge 22.

Barrel housing 24 includes towards its front end a platform 58 defined by two spaced apart raised formations 59 which are provided with curved cut-outs 60 which define the entrance to the firing chamber 23 of gun 10 and which collectively define a semi-circular tray which is of complementary shape to the lower half of a cartridge 22 so that the latter can be located on it.

The rear ends of raised formations 59 are each provided with a sloping surface 61 which together with a complementary shaped sloping surface 62 on wall 54 of chamber 53 constitutes the breach ramp of the gun and which accordingly defines a smooth path for the entry of a cartridge 22 to firing chamber 23.

Barrel housing 24 also includes towards its rear end a further elongated aperture 63 which extends right through it and which houses the hammer 64 of gun 1. Hammer 64 is rotably movable against the action of a coil spring 65 from a first or cocked position where its leading or hammering end is located inside aparture 63, to a second or firing position (indicated by dotted lines in FIGS. 3, 5, 19 and, 21) where it can engage the rear end 34 of firing pin 29 when bolt 25 is in the firing position.

Figure 10:
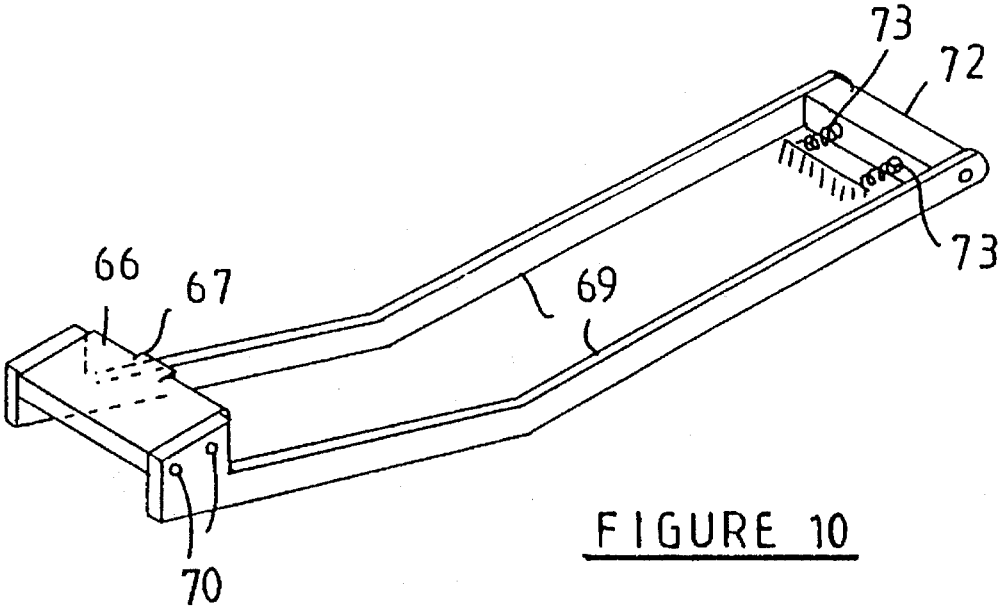
FIGS. 10 and 11 are diagrammatic perspective views showing some of the components of the trigger mechanism of FIG. 3 in more detail.
Figure 11:
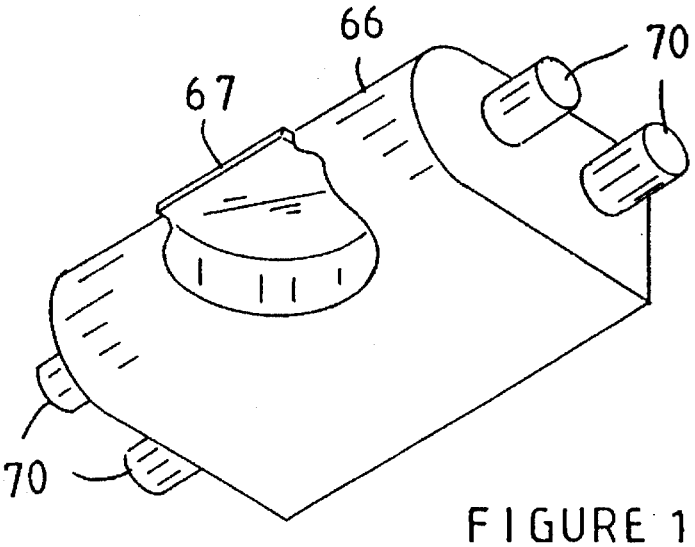

Hammer 64 is locked in the cocked position in aperture 63 by means of a movably mounted element 66 which includes a lip formation 67 (FIGS. 3, 10 and 11), element 66 being movable from one position where it defines a catch for a lip formation 68 provided on the leading end of hammer 64 to retain the latter in the cocked position, to a second position where it does not. Element 66 is located in an axially extending slot 66.1 (FIG. 8) provided in the rear end of housing 24.

The aforesaid movement of element 66 is effected by means of a pair of levers 69 which are each located in a slot provided along an opposite side of barrel housing 24. The one set of ends of levers 69 each pivotally engages a pair of pins 70 provided on element 66 and the other sat of ends each pivotally engages a pin 71 provided in opposite ends of an elongated element 72 which can be moved in the transverse direction against the biasing action of two coil springs 73 by operating the trigger 16 of gun 10.

The aforesaid arrangement is such that when bolt 25 moves towards the reload position, the rear end 34 of pin 29 carries the leading end of hammer 64 with it until it passes into the rear end of slot 35 on bolt 25 which then carries it into aperture 63 of barrel housing 24. This movement forces element 66 via levers 69 against the biasing action of spring 73 to move in the direction of arrow 74 in FIG. 3 until the leading ends of lips 67 and 68 clear each other whereafter element 66 can move under the influence of spring 73 in the opposite direction for its lip 67 to define a catch formation for lip 68 to retain hammer 64 in the cocked position.

Figure 3:
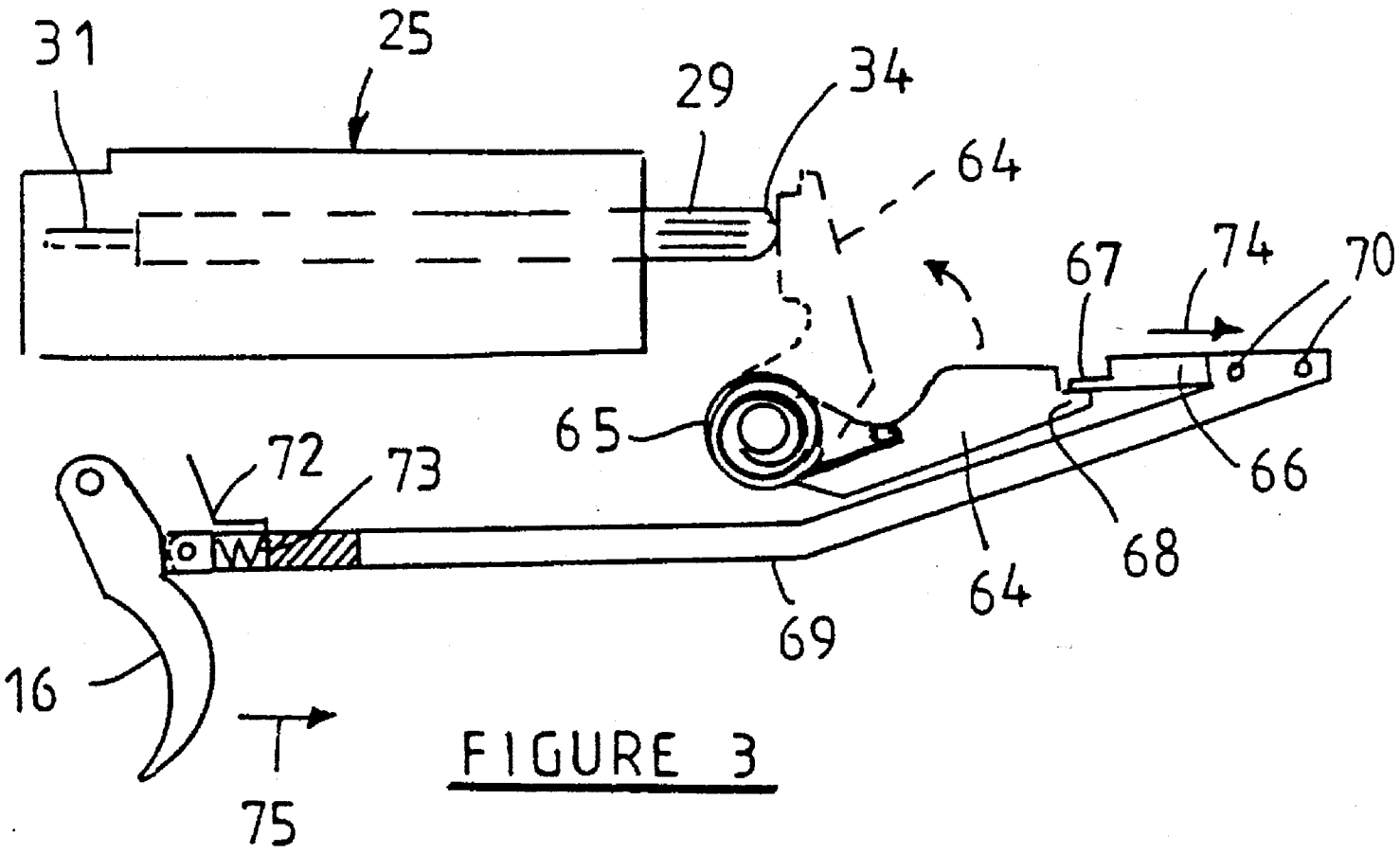
FIG. 3 is a diagrammatic side elevation of the bolt and trigger mechanism of the gun of FIG. 1.
Figure 4:
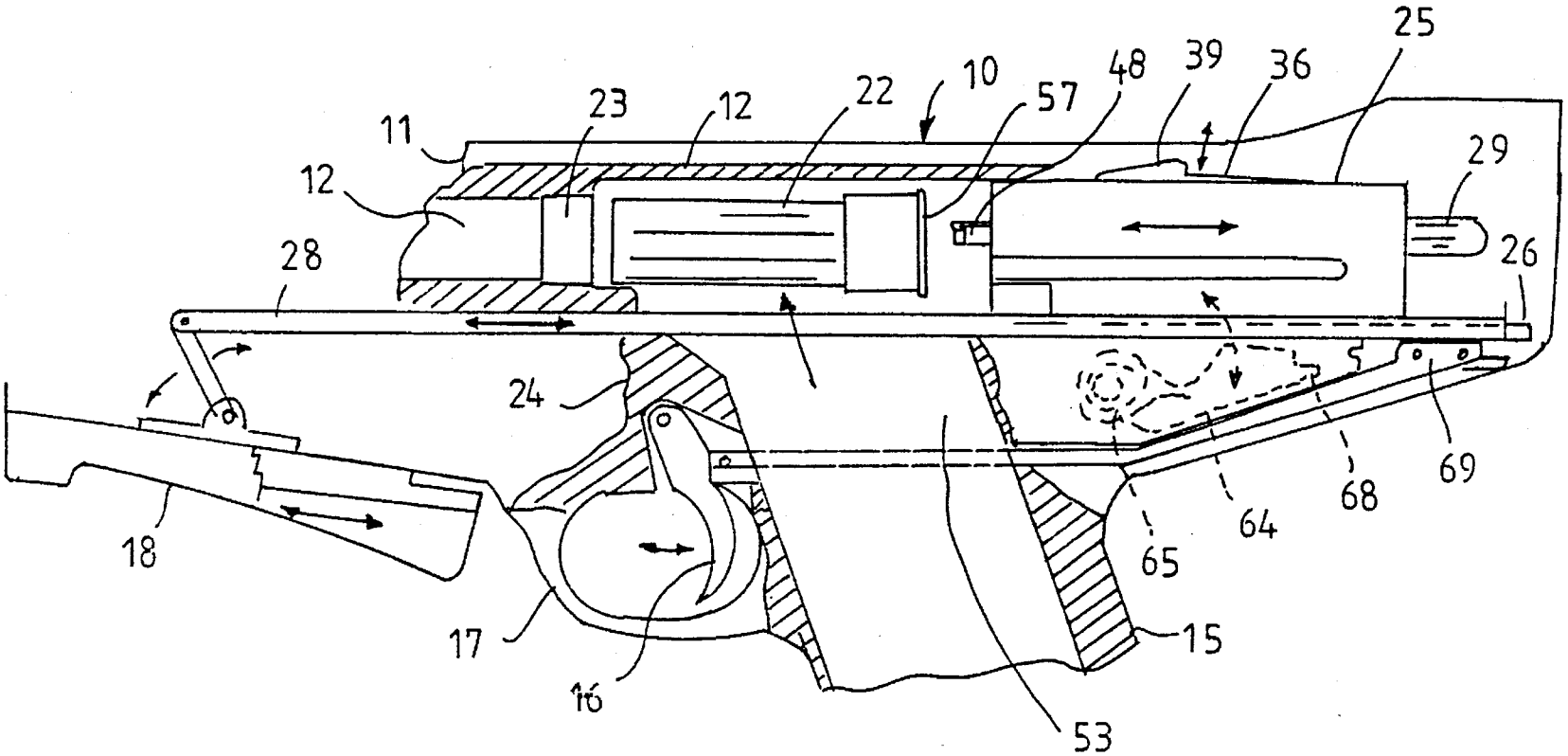
FIG. 4 is a diagrammatic longitudinal section of part of the gun of FIG. 1 showing some of its components in more detail.
Figure 5:
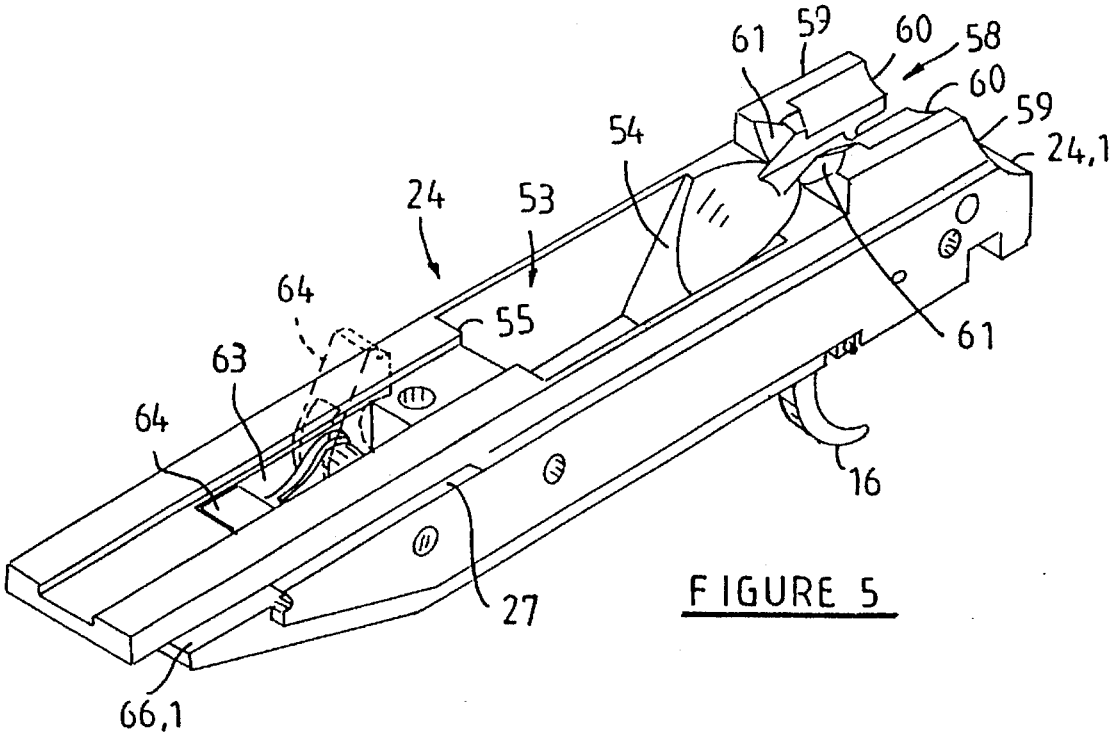
FIG. 5 is a diagrammatic perspective view showing the barrel housing of the gun of FIG. 1 in more detail.
Figure 6:
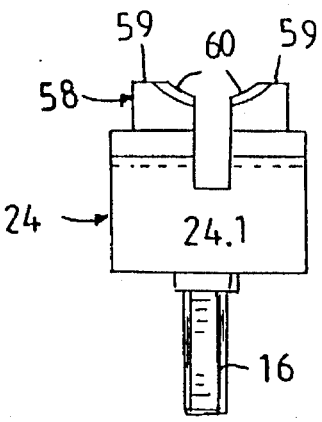
FIGS. 6 and 7 are respectively opposite end views of the housing of FIG. 5.
Figure 7:
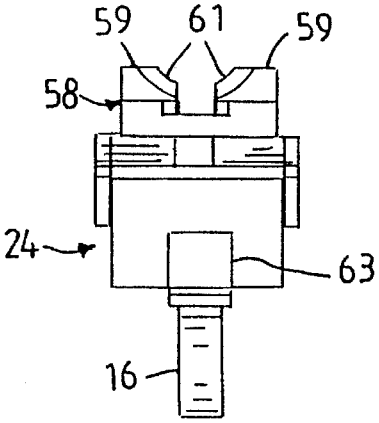
Figure 8:
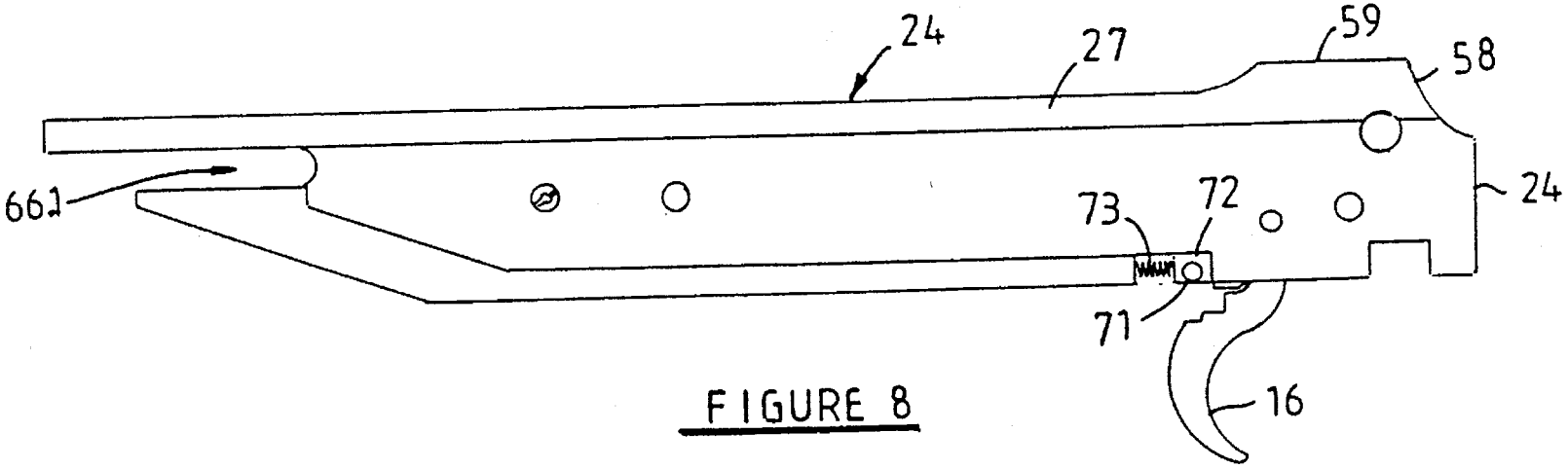
FIGS. 8 and 9 are respectively a side and a plan view of the barrel housing of FIG. 5.
Figure 9:
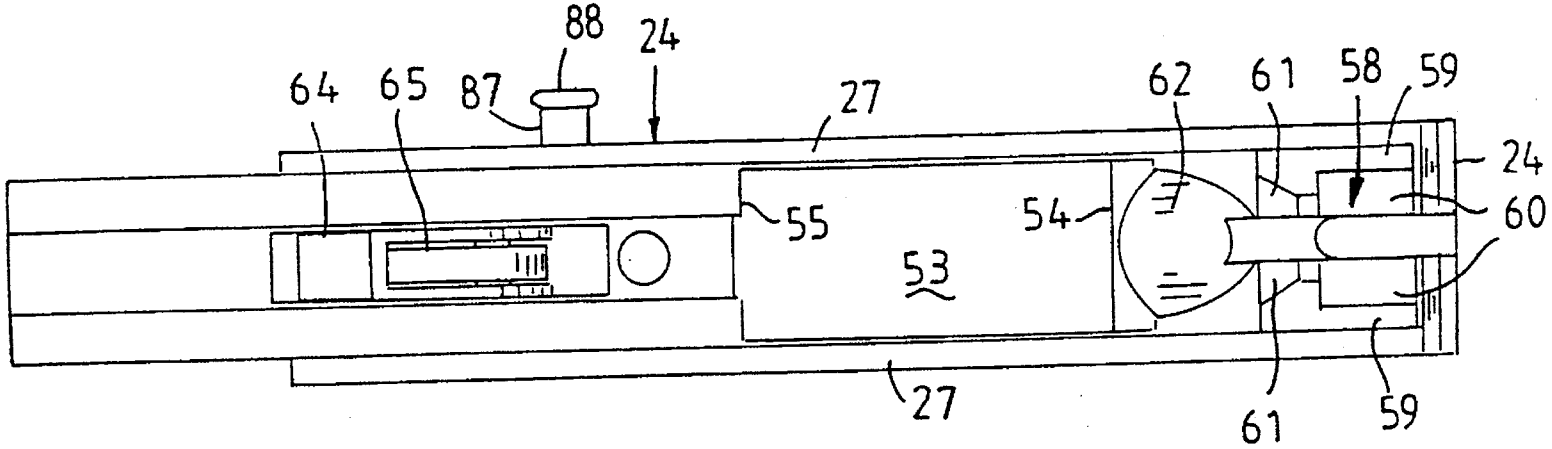

When bolt 25 then moves into the firing position, hammer 64 remains cocked until trigger 13 is pulled in the direction of arrow 75 (FIG. 3) to cause element 66 to move in the direction of arrow 74 to bring lip 67 out of engagement with lip 68 and hence allow hammer 64 to move under the influence of spring 65 to the firing position indicated in dotted lines in FIGS. 3 and 5.

Gun 10 furthermore includes a safety pin 76 (FIG. 1) which can releasably keep element 66 in that position where lips 67 and 68 engage each other irrespective of whether trigger 16 is operated. This accordingly provides a safety mechanism for preventing the accidental firing of gun 10.

Aperture 63, also includes an elongated U-shaped element 77 (FIGS. 19 to 22) comprising two spaced apart side walls 78 (FIG. 20) and an end wall 79.

Side walls 78 are provided towards the open end of element 77 with aligned apertures 80 in which a pin 81 can be received rotatably. The ends of pin 81 are secured to opposite walls of aperture 63.

Side walls 78 are also provided towards the closed end of element 77 with aligned semi-circular notches 82 which are so shaped that they can fit loosely over the pin 83 by means of which hammer 64 is pivotally connected to the side walls of aperature 63.

Pivotal movement of element 77 about pin 80 in the direction of arrow 84 (FIG. 19) is controlled by means of a first spring 85 located towards the open end of element 77, and a second coil spring 86 located towards the closed end of element 77.

Element 77 is also provided towards its closed end with a transversely extending pin 87, of which the free end protrudes into a slot in the body 11 of the gun and which is provided with a finger operable knob 88 by means of which pin 87 can be depressed into aperture 63 against the biasing action of spring 86.

Figure 19:
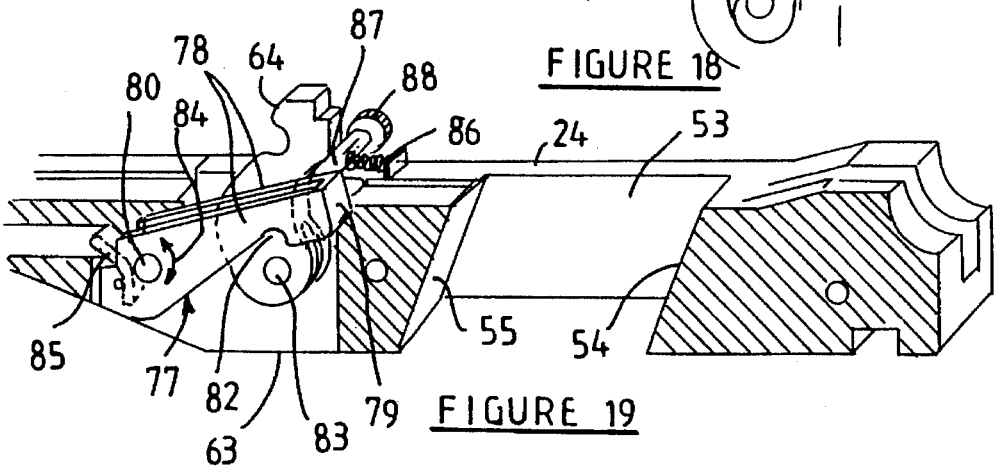
FIG. 19 is a diagrammatic perspective view of a longitudinal section of part of the barrel housing of FIG. 5.
Figure 20:
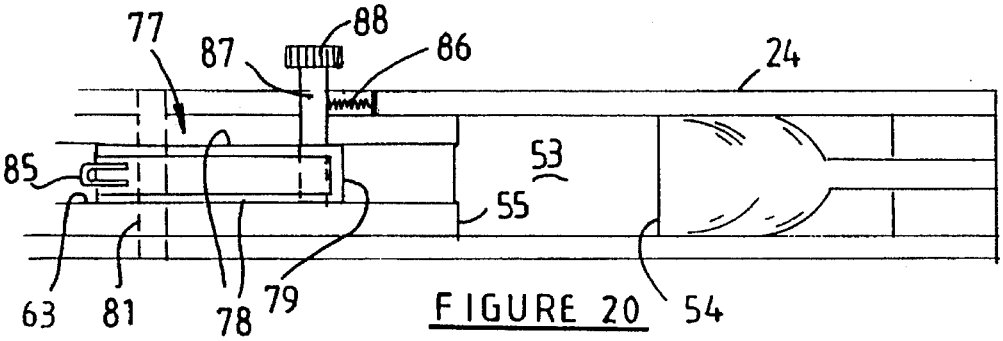
FIG. 20 is a plan view of the barrel housing shown in FIG. 5.

The position of pin 81 and the operation of springs 85 and 86 are such that the closed end of element 77 is normally urged towards the position shown in FIGS. 19 and 21 where end wall 79 projects through the open end of aperture 63 to define an obstruction in the way of firing bolt 25 when it wants to move in the direction of arrow 45 from the firing position (FIG. 21) to the reload position.

When in this position, end wall 79 accordingly constitutes the 'third' lock referred to above for maintaining bolt 25 in the firing position.

Element 77 is linked to hammer 64 of gun 1 in such a manner that after the trigger 15 has been pulled to fire the shot, element 77 is pivoted on its pin to the position where its end wall 79 is withdrawn into aperture 63 as indicated in FIG. 22 to allow bolt 25 to be moved by means of cock grip 18 to the reload position.

When the gun is in the cocked position, i.e. with bolt 25 in the firing position, and the gun has to be uncocked, pin 87 is depressed by means of knob 88 to cause end wall 79 to withdraw into aperture 63 and hence allow bolt 25 to move to the reload position.

In operation magazine 21 with cartridges 22 is pushed into pistol grip 15 from below; the second lock mechanism associated with hook 51 released by means of button 52; and gun 10 cocked in the manner described above by moving grip 18 in the direction of arrow 45 in FIG. 16, a cut out part 89 in the rear end of grip 18 allowing grip 18 to pass around trigger guard 17 so that grip 18 can move the full distance required.

Grip 18 is then moved back in the direction of arrow 44 to its original position so taking carriage 26 with it to cause the uppermost cartridge in magazine 21 to be moved via chamber 63 and sloping faces 62 and 61 defining the breach ramp of the gun into firing chamber 23. At the same time rim 57 of cartridge 22 is gripped by hook 48 on bolt 25.

When grip 18 is moved back towards its aforesaid original position, a shoulder 90 on bolt 25 (FIG. 12) will engage the end wall 91 defined by platform 58 on barrel housing 24 when bolt 25 has moved into the firing position. Further movement of carriage 26 in the direction of arrow 44 (FIG. 16) will cause carriage 26 to move relative to bolt 25 against the biasing action of the spring acting on pin 46 so causing element 36 to pivot to cause its hook 39 to engage lip 40 thus bringing the first of the aforesaid locks into operation.

At the same time hooks 51 and 51.1 will interengage to bring the second the aforesaid locks into operation. When the rear end of bolt 25 has cleared the end of element 77, the latter will also pivot to cause its end wall 79 to move out of aperture 63, thus bringing the third of the aforesaid locks into operation.

When safety pin 76 is released and trigger 16 pulled, hammer 64 is released to strike the rear end 34 of pin 29 to force firing pin 31 into the rear end of cartridge 22 in firing chamber 23 to fire the shot.

It will be appreciated that when the shot is so fired, the aforesaid three locks will serve to retain bolt 25 in the firing position.

Furthermore, the relative positions of the first, second and third locks in relation to the rear end of the firing chamber is such that the angles of the resultant forces acting on such locks when a shot is fired relative to the longitudinal axis of the barrel of the gun are twice as great for the third lock than for the second lock while that of the first lock is substantially parallel to the said axis so that the muzzle of the gun has virtually no tendency to move in the upward direction as a result of such shot being fired.

In order to cock the gun again, button 52 on grip 18 is depressed to disengage the aforesaid second lock. When grip 18 is now moved in the direction of arrow 45, the aforesaid spring acting on pin 46 causes bolt 25 to move relative to carriage 26 to disengage the aforesaid first lock.

As explained above, the aforesaid third lock will already be disengaged via the trigger mechanism of gun 1, and grip 18, and carriage 26 and bolt 25 are hence free to move in the direction of arrow 45 to the reload position.

During this movement hook 48 pulls the spent cartridge from chamber 23 to allow it to be ejected from the gun via an aperture 91 (FIG. 1) provided in the side of body 11 of gun 10. On further movement of bolt 25 towards the reload position, hammer 64 is similtanously cocked in the manner described above.

When the reload position is reached, the front end 26.1 of carriage 26 engages the front end 24.1 of barrel housing 24 which accordingly stops the rearward movement of carriage 26.

It will be appreciated that a shot gun according to the invention overcomes or at least minimises the problems referred to in the preamble of this specification encountered with the conventional type of shot gun.

It will be appreciated further that there are no doubt many variations in detail possible with a shot gun according to the invention without departing from the spirit and or scope of the appended claims.

What is claimed is:

1. A gun comprising:

a gun body having a firing chamber, a firing pin carrying bolt reciprocally carried by said gun body and movable relative to said firing chamber thereof between a forward firing position enabling said firing pin for engagement with the rear end of a cartridge located in the firing chamber and a rearward reload position;

at least two locks for positively maintaining said bolt in said firing position while and after a shot has been fired and before the gun is reloaded, said locks comprising a first lock located rearwardly of and at a level above said firing chamber, and another lock located at a level below and in a position rearwardly of said firing chamber, the distance between the first lock and a line extending at the rear end of the firing chamber at right angles to the longitudinal axis of the barrel of the gun being substantially one-half the distance between said another lock and said line.

2. The gun of claim 1 including a spring carried by said gun body, the engagement of the bolt by the first lock being against the biasing action of said spring.

3. The gun of claim 1 including a second lock located at a level below and in a position forwardly of said firing chamber, said another lock comprising a third lock, at least two of said locks simultaneously maintaining the bolt in the firing position while and after a shot has been fired.

4. The gun of claim 3 wherein the relative positions of the first, second and third locks in relation to the rear end of the firing chamber is such that the angles of the resultant forces acting on such locks when a shot is fired relative to the longitudinal axis of the barrel of the gun are substantially twice as great for the third lock than for the second lock, while the resultant force acting on the first lock is substantially parallel to said axis.

5. The gun of claim 4 wherein the distance between the first lock and said line is substantially one-quarter the distance between the second lock and said line, the distance between the second and third locks being substantially equal to the length of the barrel of the gun measured from said line to the front end of the barrel.

6. A gun comprising:

a gun body having a firing chamber;

a firing pin carrying bolt reciprocally carried by said gun body and movable relative to said firing chamber thereof between a forward firing position enabling said firing pin for engagement with the rear end of a cartridge located in the firing chamber and a rearward reload position;

at least two locks for positively maintaining said bolt in said firing position while and after a shot has been fired and before the gun is reloaded, said locks comprising a first lock located rearwardly of and at a level above said firing chamber, and at least one of two further locks comprising a second lock located at a level below and in a position forwardly of said firing chamber, and a third lock located at a level below and in a position rearwardly of the firing chamber, a carriage slidably engaging said bolt and slidably engaged along a track formed on said gun body, said bolt including an elongated slot located on that side thereof which engages the carriage, said carriage including an elongated protrusion which fits snugly into said slot, said slot and said protrusion having interengageable locking formations for positively locking the bolt against movement relative to the carriage towards the firing position, and enabling limited movement of the bolt relative to the carriage towards the reload position against the bias of a spring associated with the said first lock.

7. The gun of claim 6 wherein the carriage is elongated with a forward end adapted to engage said second lock and its other or rear end being adapted to carry the bolt.

8. The gun of claim 7 wherein the front end of said carriage is connected to a hand engageable cocking grip for manually moving said carriage from the firing position to the reload position.

9. The gun of claim 8 wherein said cocking grip is pivotally connected to the carriage via a toggle hinge.

10. The gun of claim 8 wherein said cocking grip includes a spring biased hook for releasable engagement with a complementary shaped formation on said gun body located forwardly of said firing chamber and below the level of the barrel of the gun, said hook and said formation collectively defining said second lock of the gun.

11. The gun of claim 10 wherein a finger engageable button is located on the grip for releasing the spring biased hook on the cocking grip from said spring biased engagement with said complementary formation.

12. The gun of claim 11 wherein said locking formations on said bolt are contained on an elongated element which is located in said slot for movement substantially transversely relative to the longitudinal axis of the barrel of the gun to a position where at least part of the element protrudes through an aperture formed in a side of said bolt opposite the side thereof which engages the carriage, said protruding part including a hook for positively engaging a lip on the barrel of the gun and constituting said first lock, said transverse movement of the element being effected when the bolt undergoes limited movement relative to the carriage.

13. The gun of claim 12 wherein said firing pin is movable against the biasing action of a spring in aligned apertures respectively provided in the ends of the bolt and in said elongated element of the bolt.

14. The gun of claim 12 wherein said elongated element and said firing pin are pivotally connected to one another to effect said movement.

15. The gun of claim 12 wherein an end of said locking formations on said carriage facing the firing chamber has an axially extending blind hole for housing a pin and said spring associated with the said first lock, said pin being engaged by said spring and movable against the bias thereof into said hole by said bolt when the latter undergoes said limited movement relative to the carriage towards the reload position.

16. The gun of claim 6 wherein said locking formations comprise interengageable serrations which lock positively in one direction but which allow limited movement of the bolt relative to the carriage in the opposite direction.

17. A gun comprising:

a gun body having a firing chamber;

a firing pin carrying bolt reciprocally carried by said gun body and movable relative to said firing chamber thereof between a forward firing position enabling said firing pin for engagement with the rear end of a cartridge located in the firing chamber and a rearward reload position;

at least two locks for positively maintaining said bolt in said firing position while and after a shot has been fired and before the gun is reloaded, said locks comprising a first lock located rearwardly of and at a level above said firing chamber, and at least one of two further locks comprising a second lock located at a level below and in a position forwardly of said firing chamber, and a third lock located at a level below and in a position rearwardly of the firing chamber, a carriage slidably engaging said bolt and slidably engaged along a track formed on said gun body, said bolt including an elongated slot located on that side thereof which engages the carriage, said carriage including an elongated protrusion which fits snugly into said slot, said slot and said protrusion having interengageable locking formations for positively locking the bolt against movement relative to the carriage towards the firing position, and enabling limited movement of the bolt relative to the carriage towards the reload position against the bias of a spring associated with the said first lock, an element pivotally contained towards the rear end of the barrel housing and located rearwardly of and below the level of the carriage of the gun, a spring for biasing said element, said element being movable against the bias of said spring in a transverse direction relative to the longitudinal axis of the barrel of the gun from a first position defining an obstacle in the path of movement of said carriage from said firing position, to a second position out of the way of said path, said element constituting said third lock for maintaining the bolt in the firing position.

18. The gun of claim 17, wherein movement of the aforesaid element from said first to its second position is associated with movement of the trigger mechanism of the gun.

19. The gun of claim 18 including an elongated cartridge chamber open at both ends and through which cartridges may be fed, and a spring loaded magazine for feeding cartridges towards the firing chamber of the gun.

20. The gun of claim 19 where the cartridge chamber has two transversely extending end walls which slope towards said firing chamber at an angle of about 70° relative to the longitudinal axis of the gun.

21. The gun of claim 20 wherein the upper end of the sloping wall of said cartridge chamber nearest the firing chamber defines the outlet end of the chamber and is provided with a curved sloping surface comprising a breech ramp for the gun for facilitating movement of a cartridge from said magazine via the cartridge chamber to the firing chamber.

22. The gun of claim 19 wherein the bolt is supported during said movement by said carriage, said carriage being slidably engageable along a track provided on the gun body, the upper end of the cartridge chamber being located below said track of the carriage so that when the latter moves over the said outlet on its way from the reload to the firing position, its forward end can carry a cartridge from the magazine via the breech to the firing chamber, and on moving away from the outlet on its way towards the reload position, enables a next cartridge in the magazine to move into the loading position.

23. The gun of claim 19 including an elongated pistol-type grip having an aperture extending longitudinally therethrough for holding and/or handling the gun, said grip being of substantially rectangular configuration in cross-section and extending in line with said cartridge chamber and adapted to releasably receive a cartridge magazine.

24. The gun of claim 17 including a hand operable override for moving said element from said first position to said second position.

25. The gun of claim 17 including a hammer for engagement with the rear end of said firing pin, a spring for biasing said hammer, said hammer being located such that when the bolt moves from said firing position to said reload position, said hammer moves against the bias of said spring into a releasably locked cocked position, said releasably locked position being adapted to be released by the trigger mechanism of the gun.

26. The gun of claim 25 including a safety catch for maintaining said hammer in said cocked position even if the trigger mechanism is operated.

27. The gun of claim 17 wherein said bolt includes towards its end facing the firing chamber a spring biased hook formation for engaging and gripping the rim of a cartridge when the latter is pushed by the bolt into the firing chamber so that when said bolt moves away from said firing chamber after a shot has been fired, said hook formation pulls the spent cartridge from said firing chamber for ejection from the gun through a side aperture formed in said gun body.

28. The gun of claim 17 including both said second lock and said third lock.

* * * * *